US006359605B1

(12) United States Patent
Knapp et al.

(10) Patent No.: US 6,359,605 B1
(45) Date of Patent: Mar. 19, 2002

(54) ACTIVE MATRIX ELECTROLUMINESCENT DISPLAY DEVICES

(75) Inventors: Alan G. Knapp, Crawley; Neil C. Bird, Horley, both of (GB)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/329,029

(22) Filed: Jun. 9, 1999

(30) Foreign Application Priority Data

Jun. 12, 1998 (GB) ..... 9812739

(51) Int. Cl.[7] ..... G09G 3/30

(52) U.S. Cl. ..... 345/76; 345/80; 345/206; 327/108

(58) Field of Search ..... 323/316; 327/323, 327/108; 438/158; 345/68–76, 204, 77, 80; 348/571

(56) References Cited

U.S. PATENT DOCUMENTS 4,694,341 A 9/1987 Soneda et al. ..... 348/571
4,866,368 A 9/1989 Bird ..... 323/316
5,047,360 A 9/1991 Nicholas ..... 438/158
5,594,463 A 1/1997 Sakamoto ..... 345/76
5,596,291 A 1/1997 Runas ..... 327/108
6,181,187 B1 1/2001 Daffron et al. ..... 327/323

*Primary Examiner*—Steven Saras
*Assistant Examiner*—Christopher J. Maier
(74) *Attorney, Agent, or Firm*—Aaron Waxler

(57) ABSTRACT

An active matrix electroluminescent display device has an array of current—driven electroluminescent display elements (20), for example comprising organic electroluminescent material, whose operations are each controlled by an associated switching means (10) to which a drive signal for determining a desired light output is supplied in a respective address period and which is arranged to drive the display element according to the drive signal following the address period. Each switching means comprises a current mirror circuit (24, 25, 30, 32) which samples and stores the drive signal with one transistor (24) of the circuit controlling the drive current through the display element (20) and having its gate connected to a storage capacitance (30) on which a voltage determined by the drive signal is stored. Through the use of current mirror circuits improved uniformity of light outputs from the display elements in the array is obtained.

5 Claims, 2 Drawing Sheets

ACTIVE MATRIX ELECTROLUMINESCENT DISPLAY DEVICES

BACKGROUND OF THE INVENTION

This invention relates to active matrix electroluminescent display devices comprising a matrix array of electroluminescent display elements each of which has an associated switching means for controlling the current through the display element.

Matrix display devices employing electroluminescent, light-emitting, display elements are well known. As for the display elements organic thin film electroluminescent elements and light-emitting diodes (LEDs), comprising traditional III-V semiconductor compounds, have been used. In the main, such display devices have been of the passive type in which the electroluminescent display elements are connected between intersecting sets of row and column address lines and addressed in multiplexed fashion. Recent developments in (organic) polymer electroluminescent materials have demonstrated their ability to be used practically for video display purposes and the like. Electroluminescent elements using such materials typically comprise one or more layers of a semiconducting conjugated polymer sandwiched between a pair of (anode and cathode) electrodes, one of which is transparent and the other of which is of a material suitable for injecting holes or electrons into the polymer layer. An example of such is described in an article by D. Braun and A. J. Heeger in Applied Physics Letters 58 (18) p.p. 1982–1984 (May 6, 1991). By suitable choice of the conjugated polymer chain and side chains, it is possible to adjust the bandgap, electron affinity and the ionisation potential of the polymer. An active layer of such a material can be fabricated using a CVD process or simply by a spin-coating technique using a solution of a soluble conjugated polymer. Through these processes, LEDs and displays with large light-emitting surfaces can be produced.

Organic electroluminescent materials offer advantages in that they are very efficient and require relatively low (DC) drive voltages. Moreover, in contrast to conventional LCDs, no backlight is required. In a simple matrix display device, the material is provided between sets of row and column address conductors at their intersections thereby forming a row and column array of electroluminescent display elements. By virtue of the diode-like I-V characteristic of the organic electroluminescent display elements, each element is capable of providing both a display and a switching function enabling multiplexed drive operation. However, when driving this simple matrix arrangement on a conventional row at a time scanning basis, each display element is driven to emit light for only a small fraction of the overall field time, corresponding to a row address period. In the case of an array having N rows for example, each display element can emit light for a period equal to f/N at most where f is the field period. In order then to obtain a desired mean brightness from the display, it is necessary that the peak brightness produced by each element must be at least N times the required mean brightness and the peak display element current will be at least N times the mean current. The resulting high peak currents cause problems, notably with the more rapid degradation of the display element lifetime and with voltage drops caused along the row address conductors.

One solution to these problems is to incorporate the display elements into an active matrix whereby each display element has an associated switch means which is operable to supply a drive current to the display element so as to maintain its light output for a significantly longer period than the row address period. Thus, for example, each display element circuit is loaded with an analogue (display data) drive signal once per field period in a respective row address period which drive signal is stored and is effective to maintain a required drive current through the display element for a field period until the row of display elements concerned is next addressed. This reduces the peak brightness and the peak current required by each display element by a factor of approximately N for a display with N rows. An example of such an active matrix addressed electroluminescent display device is described in EP-A-0717446. The conventional kind of active matrix circuitry used in LCDs cannot be used with electroluminescent display elements as such display elements need to continuously pass current in order to generate light whereas the LC display elements are capacitive and therefore take virtually no current and allow the drive signal voltage to be stored in the capacitance for the whole field period. In the aforementioned publication, each switch means comprises two TFTs (thin film transistors) and a storage capacitor. The anode of the display element is connected to the drain of the second TFT and the first TFT is connected to the gate of the second TFT which is connected also to one side of the capacitor. During a row address period, the first TFT is turned on by means of a row selection (gating) signal and a drive (data) signal is transferred via this TFT to the capacitor. After the removal of the selection signal the first TFT turns off and the voltage stored on the capacitor, constituting a gate voltage for the second TFT, is responsible for operation of the second TFT which is arranged to deliver electrical current to the display element. The gate of the first TFT is connected to a gate line (row conductor) common to all display elements in the same row and the source of the first TFT is connected to a source line (column conductor) common to all display elements in the same column. The drain and source electrodes of the second TFT are connected to the anode of the display element and a ground line which extends parallel to the source line and is common to all display elements in the same column. The other side of the capacitor is also connected to this ground line. The active matrix structure is fabricated on a suitable transparent, insulating, support, for example of glass, using thin film deposition and process technology similar to that used in the manufacture of AMLCDs.

With this arrangement, the drive current for the light-emitting diode display element is determined by a voltage applied to the gate of the second TFT. This current therefore depends strongly on the characteristics of that TFT. Variations in threshold voltage, mobility and dimensions of the TFT will produce unwanted variations in the display element current, and hence its light output. Such variations in the second TFTs associated with display elements over the area of the array, or between different arrays, due, for example, to manufacturing processes, lead to non-uniformity of light outputs from the display elements.

SUMMARY OF THE INVENTION

It is an object of the present invention to provide an improved active matrix electroluminescent display device.

It is another object of the present invention to provide a display element circuit for an active matrix electroluminescent display device which reduces the effect of variations in the transistor characteristics on the light output of the display elements and hence improves the uniformity of the display.

This objective is achieved in the present invention by making use of the fact that transistors fabricated close together will usually have very similar characteristics.

According to the present invention, there is provided an active matrix electroluminescent display device of the kind described in the opening paragraph which is characterised in that the switching means associated with a display element comprises a current mirror circuit which is operable to sample and store a drive signal that determines the display element drive current and applied during a display element address period and to maintain the display element drive current following the address period, the current mirror circuit comprising a first transistor whose current-carrying electrodes are connected between a supply line and an electrode of the display element, a second transistor to whose gate electrode and first current-carrying electrode the drive signal is applied and whose second current-carrying electrode is connected to the supply line, the gate of the first transistor being connected to the supply line via a storage capacitor and to the gate of the second transistor via a switch device which is operable to connect the gates of the first and second transistors during the address period. The use of a current mirror circuit in this way overcomes the aforementioned problems by ensuring that the currents driving display the elements are not subject to the effects of variations in the characteristics of individual transistors supplying the currents.

In operation of this display element circuit, a drive signal applied to the first current-carrying electrode and the gate electrode of the second transistor during an address period for the display element concerned results in a current flowing through this diode-connected transistor. By virtue of the gate electrodes of the first and second transistors being interconnected during this period by the switch device, this current is then mirrored by the first transistor to produce a drive current flow through the display element proportional to the current through the second transistor and to establish a desired voltage across the storage capacitor which is equivalent to the gate voltage on the two transistors required to produce that current. At the end of the address period the gates of the transistors are disconnected, by operation of the switch device, and the gate voltage stored on the storage capacitance serves to maintain operation of the first transistor and the drive current through the display element, and hence its desired light output, at the set level. Preferably, the characteristics of the first and second transistors forming the current mirror circuit are closely matched as the operation of the circuit is then most effective.

With this arrangement an improvement in the uniformity of light output from the display elements is achieved.

The transistors can conveniently be provided as TFTs and fabricated on a suitable, insulating, substrate. It is envisaged though that the active matrix circuitry of the device may be fabricated using IC technology using a semiconductor substrate and with the upper electrode of the display elements being of transparent material such as ITO.

Preferably, the display elements are arranged in rows and columns, and the switch devices of the current mirror circuits for a row of display elements, which preferably similarly comprise transistors such as TFTs, are connected to a respective, common, row address conductor via which a selection signal for operating the switch devices in that row is supplied, and each row address conductor is arranged to receive a selection signal in turn. The drive signals for the display elements in a column are preferably supplied via a respective column address conductor common to the display elements in the column. Similarly, the supply line is preferably shared by all display elements in the same row or column. A respective supply line may be provided for each row or column of display elements. Alternatively, a supply line could effectively be shared by all display elements in the array using for example lines extending in the column or row direction and connected together at their ends or by using lines extending in both the column and the row directions and connected together in the form of a grid. The approach selected will depend on the technological details for a given design and fabrication process.

For simplicity, a supply line which is associated with, and shared by, a row of display elements may comprise the row address conductor associated with a different, preferably adjacent, row of display elements via which a selection signal is applied to the switch devices of the current mirror circuits of that different row.

The drive signal may be supplied to the second transistor via a further switch device, for example, another transistor connected between the column address conductor and the second transistor, and operable in the case of this further switch device comprising a transistor by the selection signal applied to the row address conductor. However, in the case where the supply line is constituted by an adjacent row conductor the need to provide such a further switch device may be avoided by using an appropriate drive waveform on the adjacent row address conductor to which the first and second transistors are connected which includes, in addition to the selection signal intended for the switch devices of the adjacent row of display elements, a further voltage level at the appropriate time, i.e. during the address period for the row of display elements concerned, which causes the diode-connected second transistor to conduct.

In the case where an adjacent row address conductor is not used as the supply line connected to the first and second transistors, then as the rows of display elements are addressed separately, i.e. one at a time in sequence, it is possible for the second transistor of the current mirror circuit to be shared by, and thus common to, the current mirror circuits of all the display elements in the same column. To this end, this diode-connected second transistor may be connected between the column address conductor and a source of potential corresponding to that of the supply line and the gate of the first transistor connected to the column address conductor through the switch device. As before, the application of a drive signal to the column address conductor generates a current which flows through this transistor and the column address conductor thus has a potential relative to the potential of the supply line equal to the voltage across the transistor. Assuming the switch device of the display element is turned on this voltage is applied to the gate of the first transistor, and the storage capacitor, so that the two transistors form a current mirror as before. This arrangement has the advantage that the number of transistors required for the display elements of each column is considerably reduced which is not only likely to improve yield but also increase the area available for each display element.

BRIEF DESCRIPTION OF THE DRAWING

Embodiments of active matrix electroluminescent display devices in accordance with the invention will now be described, by way of example, with reference to the accompanying drawings, in which.

The figures are merely schematic and have not been drawn to scale. The same reference numbers are used throughout the figures to denote the same or similar parts.

DESCRIPTION OF THE PREFERRED EMBODIMENTS

Figure 1:
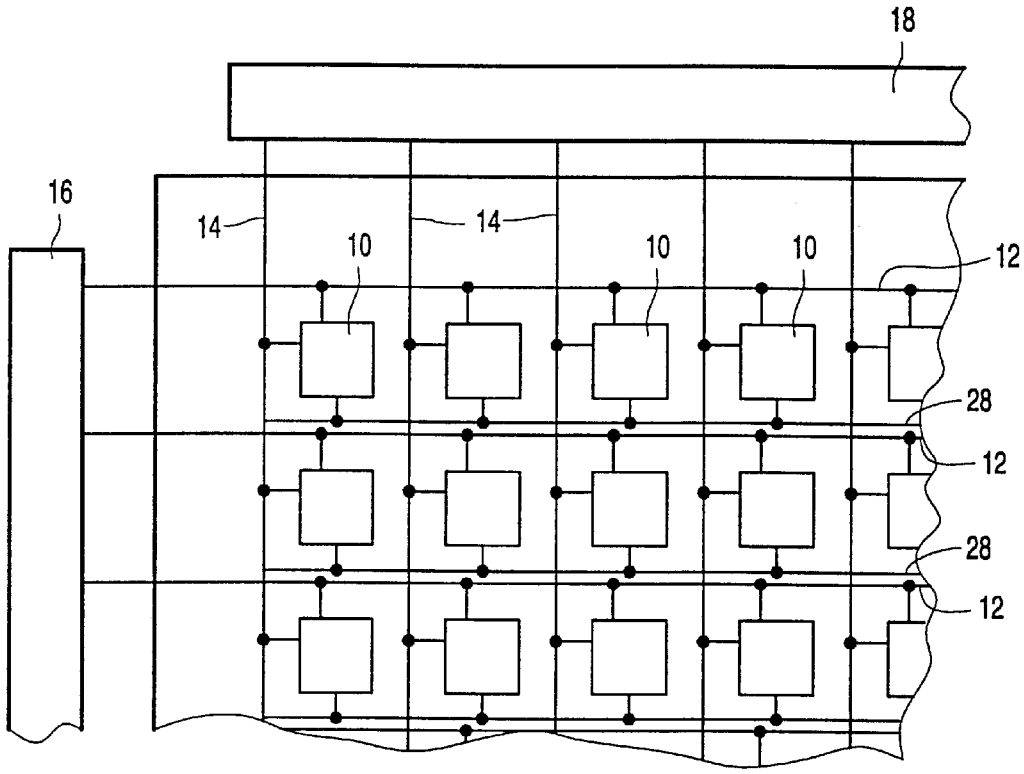
FIG. 1 is a simplified schematic diagram of part of an embodiment of display device according to the invention.

Referring to FIG. 1, the active matrix addressed electroluminescent display device comprises a panel having a row and column matrix array of regularly-spaced pixels, denoted by the blocks 10 and comprising electroluminescent display elements together with associated switching means, located at the intersections between crossing sets of row (selection) and column (data) address conductors, or lines, 12 and 14. Only a few pixels are shown in the Figure for simplicity. In practice there may be several hundred rows and columns of pixels. The pixels 10 are addressed via the sets of row and column address conductors by a peripheral drive circuit comprising a row, scanning, driver circuit 16 and a column, data, driver circuit 18 connected to the ends of the respective sets of conductors.

Figure 2:
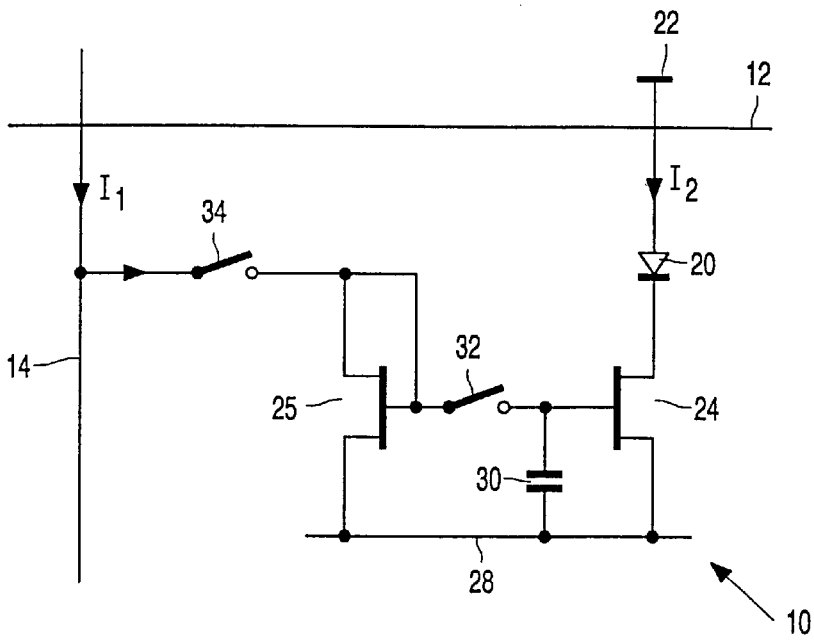
FIG. 2 shows the equivalent circuit of a basic form of a typical display element and its associated control circuitry in the display device of FIG. 1.

FIG. 2 illustrates the circuitry of a basic form of a typical one of the blocks 10 in the array. The electroluminescent display element, here referenced at 20, comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 20 closest to the substrate can consist of a transparent conductive material such as ITO so that light generated by the electroluminescent layer is transmitted through these electrodes and the support so as to be visible to a viewer at the other side of the support. In this particular embodiment though the light output is intended to be viewed from above the panel and the display element anodes comprise parts of a continuous ITO layer 22 connected to a potential source and constituting a second supply line common to all display elements in the array held at a fixed reference potential. The cathodes of the display elements comprise a metal having a low work-function such as calcium or a magnesium: silver alloy. Typically, the thickness of the organic electroluminescent material layer is between 100 nm and 200 nm. Typical examples of suitable organic electroluminescent materials which can be used for the elements 20 are described in EP-A-0 717446 to which reference is invited for further information and whose disclosure in this respect is incorporated herein. Electroluminescent materials such as conjugated polymer materials described in WO96/36959 can also be used.

Each display element 20 has an associated switch means which is connected to the row and column conductors 12 and 14 adjacent the display element and which is arranged to store an applied analogue drive (data) signal level that determines the element's drive current, and hence light output (grey-scale), and to operate the display element in accordance with that signal. The display data signals are provided by the column driver circuit 18 which acts as a current source. A suitably processed video signal is supplied to the driver circuit 18 which samples the video signal and applies a current constituting a data signal related to the video information to each of the column conductors in a manner appropriate to row at a time addressing of the array with the operations of the column driver circuit and the scanning row driver circuit being appropriately synchronised.

The switch means basically comprises a current-mirror circuit formed by first and second field-effect transistors 24 and 25 in the form of TFTs. The current carrying, source and drain, electrodes of the first TFT 24 are connected between the cathode of the display element 20 and a supply line 28 and its gate is connected to one side of a storage capacitor 30 whose other side is also connected to the supply line. The gate and the one side of the capacitor 30 are connected also via switch 32 to the gate of the second TFT 25 which is diode-connected, with its gate and one of its current-carrying electrodes (i.e. drain) being interconnected. Its other (source) current-carrying electrode is connected to the supply line 28 and its source and gate electrodes are connected, via another switch 34, to the associated column conductor 14. The two switches 32 and 34 are arranged to be operated simultaneously by a signal applied to the row conductor 12.

Figure 3:
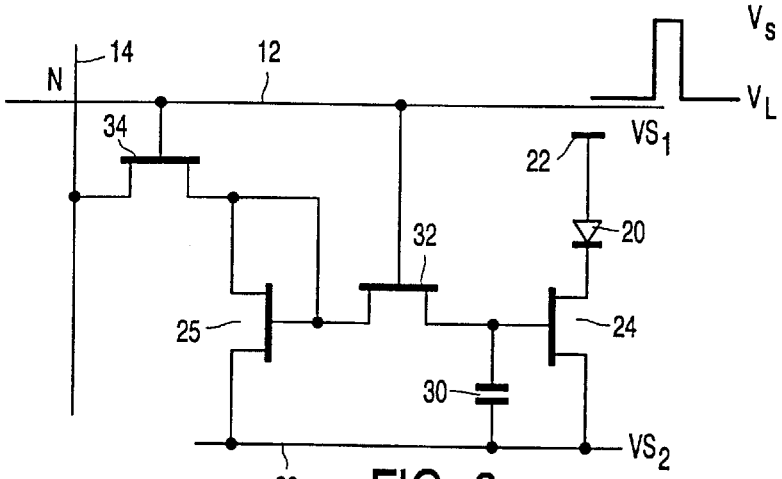
FIG. 3 illustrates a practical realisation of the basic display element circuit of FIG. 2.

In practice, the two switches 32 and 34 can comprise further TFTs, as illustrated in FIG. 3, whose gates are connected directly to the row conductor 12, although the use of other types of switches, such as micro-relays or micro-switches is envisaged.

The matrix structure, comprising the TFTs, the sets of address lines, the storage capacitors, the display element electrodes and their interconnections, is formed using standard thin film processing technology similar to that used in active matrix LCDs which basically involves the deposition and patterning of various thin film layers of conductive, insulating and semiconductive materials on the surface of an insulating support by CVD deposition and photolithographic patterning techniques. An example of such is described in the aforementioned EP-A-0717446. The TFTs may comprise amorphous silicon or polycrystalline silicon TFTs. The organic electroluminescent material layer of the display elements may be formed by vapour deposition or by another suitable known technique, such as spin coating.

In operation of the device, a selection (gating) signal is applied by the row driver circuit 16 to each of the row conductors in turn in a row respective row address period, as signified by the positive pulse signal Vs in the row waveform applied to the Nth row depicted in FIG. 3. Thus, the switches 32 and 34 of the display elements in a given row are closed by such a selection signal while the switches 32 and 34 of the display elements in all other rows remain open. The supply line 28, like the common electrode 22, is held at a fixed, predetermined, referenced potential. A current $I_1$ flowing in the column conductor 14 from the column driver circuit 18 flows through the switch 34 and through the diode-connected TFT 25. The TFT 25 effectively samples the input current and this current, $I_1$, is then mirrored by the TFT 24 to produce a current 12 through the display element 20 which current $I_2$ is proportional to $I_1$ with the constant of proportionality being determined by the relative geometries of the TFTs 24 and 25. In the particular case where TFTs 24 and 25 have identical geometries then $I_2$ will be equal to $I_1$. Once the current $I_2$ in the TFT 24 and the display element 20 have been established at the desired value, the duration of the row address period defined by the selection signal Vs being sufficient to allow such current flow to stabilise, the voltage across the storage capacitor 30 becomes equal to the gate voltage on the TFTs 24 and 25 required to produce this current. At the termination of the row selection signal Vs, corresponding to the end of the row address period, the voltage on the row conductor 12 drops to a lower, more negative, level $V_L$ and the switches 32 and 34 are opened, thereby disconnecting the TFT 24 from the gate of the TFT 25. Because the gate voltage of the TFT 24 is stored on the capacitor 30, the TFT 24 remains on and the current $I_2$ through the TFT 24 continues to flow and the display element 20 continues to operate at the desired level with the gate voltage determining the current level. A small change in the value of $I_2$ might be produced through a change in the gate voltage of the TFT 24 at that point when the switch 32 is opened due to coupling or charge injection effects from the device used for the switch 32 but any error likely in this respect can readily be compensated by a slight adjustment in the original value of the current $I_1$ so as to produce the correct value of $I_2$ after the switch 32 has opened.

The column drive circuit 18 applies the appropriate current drive signals to each column conductor 14 so as to set all the display elements in a row to their required drive level simultaneously in the row address period. Following the addressing of a row in this way, the next row of display elements is addressed in like manner with the column signals supplied by the column driver circuit 18 being changed as appropriate to correspond to the drive currents required by the display elements in that next row. Each row of display elements is address in this manner sequentially, so that in one field period all the display elements in the array are addressed and set to their required drive level, and the rows are repeatedly addressed in subsequent field periods.

The voltage supplies VS2 and VS1 for the supply line 28 and the common anode electrode 22 (FIG. 3) from which the display element diode current is drawn may be separate connections which are common to the whole array or VS1 may be a separate connection while VS2 is connected to either the previous, (N−1)th, row conductor 12 or the next, (N+1)th, row conductor 12 in the array, i.e. a row conductor different from and adjacent that to which the switches 32 and 34 are connected, bearing in mind that the voltage on a row conductor 12 is at constant level ($V_L$)except for a relatively short row address period. In the latter case, the row driver circuit 16 must, of course, be capable of supplying the drive current for all the display elements 20 in the row it serves when its output for a row conductor is in the low level state where the switches 32 and 34 are turned off.

Figure 4:
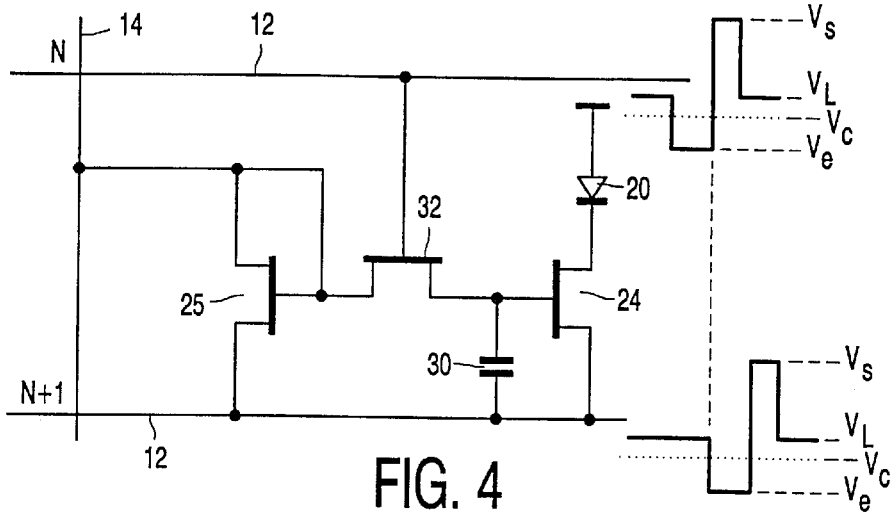
FIG. 4 shows a modified form of the display element circuit together with associated drive waveforms.

The circuit of FIG. 3 can be simplified to an extent by removing the switch 34 and using an alternative row drive waveform as illustrated in the embodiment of FIG. 4. In this embodiment, the supply line 28 for the Nth row of display elements is constituted by the (N+1)th row conductor 12 associated with the next, i.e. the subsequently addressed, row of display elements. However, the supply line 28 could instead be constituted by the (N−1)th row conductor. The row drive waveform applied to each row conductor by the row driver circuit 16 has an extra voltage level, $V_e$, in addition to the select and low levels $V_s$ and $V_L$ which immediately precedes the selection signal $V_s$ in the case of the arrangement of FIG. 4. In the case of the supply line 28 being constituted instead by the preceding, (N−1)th, row conductor 12 the extra voltage level immediately succeeds the selection signal. The principle of operation in this embodiment relies on the fact that the TFT 25 is diode-connected and so will only conduct if its source electrode, i.e. the electrode connected to the supply line 28, is negative with respect to its interconnected drain and gate electrodes. The TFT 25 is thus turned on by taking the (N+1)th row conductor 12 to a voltage $V_e$ which is negative with respect to the most negative voltage that can appear on the column conductor 14, the latter voltage being denoted by the dotted lines, $V_c$, in FIG. 4. The voltage on the column conductor can, of course, have a range of possible values. The level $V_e$ commences substantially at the same time as the selection pulse $V_s$ on the Nth row conductor which turns on the switch 32 and so both the TFT 25 and the switch 32 are turned on simultaneously. The operation of the current mirror circuit and the driving of the display element then continues as previously described. At the termination of the selection signal $V_s$ on the Nth row conductor the switch 32 turns off by virtue of the voltage on that conductor returning to $V_L$, and slightly thereafter the TFT 25 is turned off as the voltage on the (N+1)th row conductor changes from $V_e$ to $V_s$ upon the next row being selected, and remains off when the voltage on the row conductor returns to $V_L$ after selection signal since $V_L$ is chosen to be positive relative to the column conductor voltage $V_C$.

In practice, the voltage on the column conductor 14 will vary over a small range of values, the actual value constituting a data signal which determines the drive current required for the display element. It is only necessary to ensure that the level of $V_e$ is sufficiently below the lowest voltage for the current mirror to operate correctly and that $V_L$ is positive relative to the most positive voltage on the column conductor 14 so that the TFT 25 is always off when the (N+1)th row conductor is at the level $V_L$.

Figure 5:
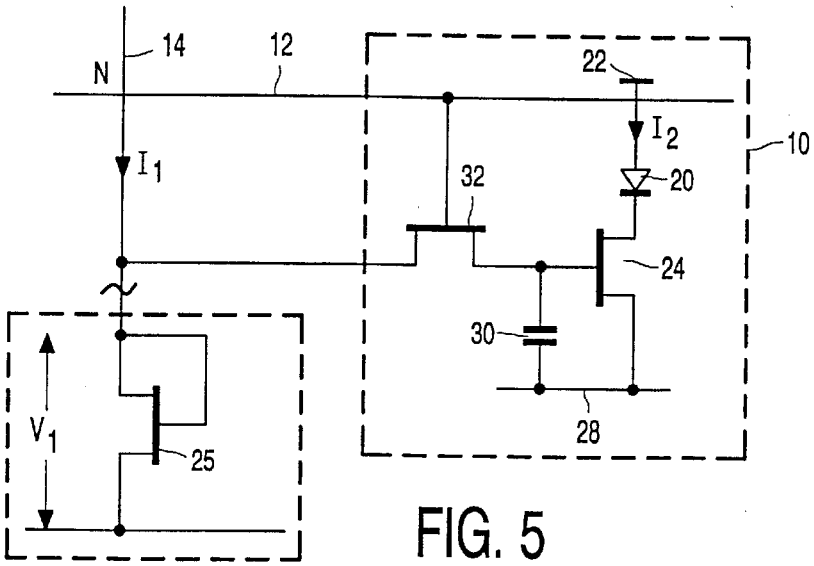
FIG. 5 shows an alternative form of control circuitry for a display element.

A further alternative circuit configuration is shown schematically in FIG. 5. This is similar to the arrangements of FIGS. 3 and 4 except that the diode-connected TFT 25, which forms half the current mirror circuit, is here shared between the switching means of all the display elements in the same column rather than the switching means for each display element requiring a respective TFT 25. As before, the column driver circuit 18 operates to generate a current $I_1$ in the column conductor 14 for determining the drive level of a display element which current flows into the TFT 25. The diode-connected TFT 25 is connected between the column conductor 14 and the supply line 28, preferably at one or other end of the column conductor 14. The column conductor 14 thus has a potential relative to the level VS2 on the supply line 28 equal to the voltage, $V_1$, across the TFT 25. The appropriate row of the array is selected by applying a selection signal to the row conductor 12 associated with that row so as to turn on the switches 32 in that row and the voltage $V_1$ is then effectively applied to the gate of the TFT 24 via the switch 32 so that the TFTs 24 and 25 form a current mirror as described previously. Once the current, $I_2$, flowing through the TFT 24 has stabilised, the switch 32 is opened, upon termination of the selection pulse signal on the row conductor 12, allowing the supply of drive current through the display element to be continued via the TFT 24, and the operation is then repeated for the next row of display elements. The row drive waveform required for this embodiment is basically the same as that for the FIG. 3 embodiment.

This embodiment has the advantage of reducing the number of TFTs required at each display element location which can lead to improved yields and, where the light output from the display element is emitted through the glass support, an increase in the area available for the light output.

In all the above-described embodiments, the TFTs used, including the switches 32 and 34 when there are implemented in TFT form, all comprise n type transistors. However, exactly the same mode of operation is possible if these devices are all p type transistors instead, with the diode polarity of the display elements being reversed and with the row selection signals being inverted so that the selection of a row occurs when a negative voltage ($-V_s$) is applied. In the case of the FIG. 4 embodiment the extra voltage level $V_e$ would then be positive with respect to $V_L$ and $V_L$ would be positive with respect to $V_s$. There may be technological reasons for preferring one or other orientation of the diode display elements so that a display device using p-channel TFTs is desirable. For example, the material required for the cathode of a display element using organic electroluminescent material would normally have a low work function and typically would comprise a magnesium-based alloy or calcium. Such materials tend to be difficult to pattern photolithographically and hence a continuous layer of such material common to all display elements in the array may be preferred.

With regard to all the described embodiments, the operation of the current mirror circuits in the switch means for the individual display elements is most effective when the characteristics of the TFTs 24 and 25 forming the circuits are closely matched. As will be apparent to skilled persons, a number of techniques are known in the field of TFT fabrication for minimising the effects of mask misalignments on the matching of the transistor characteristics, for example as employed in the manufacture of active matrix switching arrays in AMLCDs, which can readily be applied.

The supply lines 28 may be individual or connected together at their ends. Instead of extending in the row direction and being common to a respective row of display elements, the supply lines may extend in the column direction with each line then being common to a respective column of display elements. Alternatively, supply lines extending in both the row and column directions and connected together to form a grid may be used.

It is envisaged that instead of using thin film technology to form the TFTs and capacitors on an insulating substrate, the active matrix circuitry could be fabricated using IC technology on a semiconductor, for example, silicon, substrate. The upper electrodes of the LED display elements provided on this substrate would then be formed of transparent conductive material, e.g. ITO, with the light output of the elements being viewed through these upper electrodes.

Although the above embodiments have been described with reference to organic electroluminescent display elements in particular, it will be appreciated that other kinds of electroluminescent display elements comprising electroluminescent material through which current is passed to generate light output may be used instead.

The display device may be a monochrome or multi-colour display device. A colour display device may be provided by using different light colour emitting display elements in the array. The different colour emitting display elements may typically be provided in a regular, repeating pattern of, for example, red, green and blue colour light emitting display elements.

In summary, an active matrix electroluminescent display device has an array of current-driven electroluminescent display elements, for example comprising organic electroluminescent material, whose operations are each controlled by an associated switching means to which a drive signal for determining a desired light output is supplied in a respective address period and which is arranged to drive the display element according to the drive signal following the address period. Each switching means comprises a current mirror circuit which samples and stores the drive signal with one transistor of the circuit controlling the drive current through the display element and having its gate connected to a storage capacitance on which a voltage determined by the drive signal is stored. Through the use of current mirror circuits improved uniformity of light outputs from the display elements in the array is obtained.

From reading the present disclosure, other modifications will be apparent to persons skilled in the art. Such modifications may involve other features which are already known in the field of matrix electroluminescent displays and component parts thereof and which may be used instead of or in addition to features already described herein.

What is claimed is:

1. An active matrix electroluminescent display device comprising a matrix array of electroluminescent display elements each of which has an associated switching means for controlling the current through the display element, characterised in that the switching means associated with a display element comprises a current mirror circuit which is operable to sample and store a drive signal that determines the display element drive current applied during a display element address period, and to maintain the display element drive current following the address period, the current mirror circuit comprising a first transistor whose current-carrying electrodes are connected between a supply line and an electrode of the display element, a second transistor to whose gate electrode and first current-carrying electrode the drive signal is applied and whose second current-carrying electrode is connected to the supply line, the gate of the first transistor being connected to the supply line via a storage capacitor and to the gate of the second transistor via a switch device which is operable to connect the gates of the first and second transistors during the address period;

further characterised in that the display elements are arranged in rows and columns, and the switch devices of the current mirror circuits for a row of display elements are connected to a respective common, row address conductor via which a selection signal for operating the switch devices in that row is applied, and each row address conductor is arranged to receive a selection signal in turn, characterised in that each row or column of display elements is associated with a respective supply line which is shared by all the display elements in the row or column, and further characterised in that the supply line is associated with, and common to, a row of display elements and comprises a row address conductor associated with an adjacent row of display elements via which a selection signal is applied to the switch devices of the current mirror circuits of the adjacent row.

2. An active matrix electroluminescent display device according to claim 1, characterised in that a drive waveform is applied to each row address conductor which, in addition to a selection signal for operating the switch devices of an associated row of display elements, includes a voltage level which voltage level is arranged to operate the second switch devices in a row of display elements adjacent to the associated row, and whose first and second transistors are connected to the row address conductor, during the row address period for that adjacent row of display elements.

3. An active matrix electroluminescent display device comprising a matrix array of electroluminescent display elements each of which has an associated switching means for controlling the current through the display element, characterised in that the switching means associated with a display element comprises a current mirror circuit which is operable to sample and store a drive signal that determines the display element drive current applied during a display element address period, and to maintain the display element drive current following the address period, the current mirror circuit comprising a first transistor whose current-carrying electrodes are connected between a supply line and an electrode of the display element, a second transistor to whose gate electrode and first current-carrying electrode the drive signal is applied and whose second current-carrying electrode is connected to the supply line, the gate of the first transistor being connected to the supply line via a storage capacitor and to the gate of the second transistor via a switch device which is operable to connect the gates of the first and second transistors during the address period; and further characterised in that the display elements are arranged in rows and columns, and the switch devices of the current mirror circuits for a row of display elements are connected to a respective common, row address conductor via which a selection signal for operating the switch devices in that row is applied, and each row address conductor is arranged to receive a selection signal in turn, characterised in that the drive signal is supplied to the second transistor via a further switch device connected between the column address conductor and the second transistor, which further switch device is arranged to be operated during the address period.

4. An active matrix electroluminescent display device comprising a matrix array of electroluminescent display elements each of which has an associated switching means for controlling the current through the display element, characterised in that the switching means associated with a display element comprises a current mirror circuit which is operable to sample and store a drive signal that determines the display element drive current applied during a display element address period, and to maintain the display element drive current following the address period, the current mirror circuit comprising a first transistor whose current-carrying electrodes are connected between a supply line and an electrode of the display element, a second transistor to whose gate electrode and first current-carrying electrode the drive signal is applied and whose second current-carrying electrode is connected to the supply line, the gate of the first transistor being connected to the supply line via a storage capacitor and to the gate of the second transistor via a switch device which is operable to connect the gates of the first and second transistors during the address period; and further characterised in that the display elements are arranged in rows and columns, and the switch devices of the current mirror circuits for a row of display elements are connected to a respective common, row address conductor via which a selection signal for operating the switch devices in that row is applied, and each row address conductor is arranged to receive a selection signal in turn, characterised in that the second transistor of the current mirror circuit associated with one display element is shared by the current mirror circuits associated with all the display elements in the same column.

5. An active matrix electroluminescent display device according to claim 4, characterised in that the shared second transistor is connected between the respective column address conductor and a source of potential corresponding to that of the supply line, and the gates of the first transistors of the current mirror circuits of the column of display elements are connected to the column address conductor through the switch devices.

* * * * *